US010100486B2

(12) United States Patent
Revel-Muroz et al.

(10) Patent No.: US 10,100,486 B2
(45) Date of Patent: Oct. 16, 2018

(54) METHOD FOR INSTALLING OVERHEAD TRANSMISSION LINE SUPPORTS ON PERMAFROST SOILS

(71) Applicants: Public Joint Stock Company "Transneft", Moscow (RU); Joint-stock company "Transneft Siberia", Tyumen (RU); L.L.C. "Transneft Research and Development Institute for Oil and Oil Products Transportation", Moscow (RU)

(72) Inventors: Pavel Aleksandrovich Revel-Muroz, Moscow (RU); Nikolai Vladimirovich Smirnov, Ostrovtsy (RU); Vitaly Aleksandrovich Kumallagov, Moscow (RU); Evgenii Evgenievich Semin, Moscow (RU); Alexandr Vladimirovich Ivakin, Moscow (RU); Yury Vasilevich Bogatenkov, Tyumen (RU); Mikhail Yurevich Zotov, Lytkarino (RU)

(73) Assignees: Public Joint Stock Company "Transneft", Moscow (RU); Joint-Stock Company "Transneft Siberia", Tyumen (RU); L.L.C. "Transneft Research and Development Institute for Oil and Oil Products Transportation", Moscow (RU)

( * ) Notice: Subject to any disclaimer, the term of this patent is extended or adjusted under 35 U.S.C. 154(b) by 0 days.

(21) Appl. No.: 15/226,876

(22) Filed: Aug. 2, 2016

(65) Prior Publication Data

US 2016/0340858 A1 Nov. 24, 2016

Related U.S. Application Data

(63) Continuation of application No. PCT/RU2014/000209, filed on Mar. 28, 2014.

(51) Int. Cl.
*E02D 31/14* (2006.01)
*E02D 27/35* (2006.01)
(Continued)

(52) U.S. Cl.
CPC ..... *E02D 31/14* (2013.01); *E02D 5/60* (2013.01); *E02D 7/02* (2013.01); *E02D 27/12* (2013.01);
(Continued)

(58) Field of Classification Search
CPC combination set(s) only.
See application file for complete search history.

(56) References Cited

U.S. PATENT DOCUMENTS 3,217,791 A 11/1965 Long
3,370,998 A * 2/1968 Wiswell, Jr. ..... E02D 5/226 156/212
(Continued)

FOREIGN PATENT DOCUMENTS

CA 2540185 3/2005
CN 2148777 12/1993
(Continued)

OTHER PUBLICATIONS

Lyazgin, A.L. et al; "*Stabilization of Pile Foundations Subjected to Frost Heave and in Thawing Permafrost*"; Swets & Zeitlinger, Lisse, 2003, pp. 707-711; (5 pages).
(Continued)

*Primary Examiner* — Sean D Andrish
(74) *Attorney, Agent, or Firm* — One LLP; Jonathan Jaech

(57) ABSTRACT

A method for installing pile foundations for power transmission towers or the like in different types of soil prone to frost heaving provides piles with bearing capacity against horizontal loads, reduced labor content and installation cost, and increased reliability against the impact of frost heaving forces of the soil on the pile. A casing pipe is driven in and then the pile is inserted into it, while installing rigid elements on the pile shaft by welding. When driving the pile, when a mark indicating a point of installation for a rigid element reaches the top of the casing pipe, a geometric measurement of gaps is made between the casing pipe and the pile. Based on the measurement, rigid elements are sized and welded in pairs on the opposite side in a vertical plane. The operation of placing and welding is then repeated during the pipe inserting.

13 Claims, 1 Drawing Sheet

(51) Int. Cl.

| | |
|---|---|
| ***E02D 5/60*** | (2006.01) |
| ***E02D 7/02*** | (2006.01) |
| ***E02D 27/12*** | (2006.01) |
| ***E02D 27/42*** | (2006.01) |
| ***E04H 12/00*** | (2006.01) |
| ***E04H 12/22*** | (2006.01) |

(52) U.S. Cl.
CPC ..... *E02D 27/35* (2013.01); *E02D 27/42* (2013.01); *E04H 12/00* (2013.01); *E04H 12/2215* (2013.01)

(56) References Cited

U.S. PATENT DOCUMENTS

| | | | | |
|---|---|---|---|---|
| 3,630,037 | A | 12/1971 | Howard | |
| 3,881,320 | A | 5/1975 | Gendron | |
| 4,723,876 | A | 2/1988 | Spalding et al. | |
| 5,219,249 | A | 6/1993 | Junsheng et al. | |
| 5,661,932 | A | 9/1997 | Barefield | |
| 6,231,270 | B1 * | 5/2001 | Cacossa | E02D 5/32 175/424 |
| 6,665,990 | B1 | 12/2003 | Cody et al. | |
| 7,533,505 | B2 | 5/2009 | Henderson | |
| 7,641,756 | B2 * | 1/2010 | Schwert | B29C 63/36 118/306 |
| 8,608,409 | B2 | 12/2013 | Collina et al. | |
| 2009/0110540 | A1 * | 4/2009 | Bywaters | F03D 7/0296 415/47 |
| 2014/0352449 | A1 | 12/2014 | Hale et al. | |
| 2016/0017562 | A1 | 1/2016 | Barron et al. | |

FOREIGN PATENT DOCUMENTS

| | | |
|---|---|---|
| CN | 2695482 | 4/2005 |
| CN | 201087402 | 7/2008 |
| CN | 101899830 | 12/2010 |
| CN | 102041814 | 5/2011 |
| CN | 103147435 | 6/2013 |
| CN | 103422499 | * 12/2013 |
| CN | 104278690 | 1/2015 |
| CN | 105672321 | 6/2016 |
| CN | 105672344 | 6/2016 |
| DE | 3228198 | 2/1984 |
| EP | 1046753 | 10/2000 |
| EP | 2672012 | * 12/2013 |
| JP | 61-134425 | 6/1986 |
| JP | 02183006 | * 7/1990 |
| JP | 5222723 | 8/1993 |
| RU | 2295006 | 3/2007 |
| RU | 2295007 | 3/2007 |
| RU | 2303103 | 4/2007 |
| RU | 85171 | 7/2009 |
| RU | 2386749 | 4/2010 |
| RU | 118324 | 7/2012 |
| RU | 123795 | 1/2013 |
| RU | 2027827 | 2/2015 |
| RU | 2556588 | 7/2015 |
| RU | 2556589 | 7/2015 |

OTHER PUBLICATIONS

Kondrat'ev, V.; "*Strengthening of Supports for Contact Systems and Overhead Transmission Lines Erected on Heaving Seasonally Thawing Soils*"; Soil Mechanixs & Foundation Engineering, vol. 41 Issue 5, Sep. 2004; (1 page).

Niranjan, Kapil Kant; "*Pile-Foundation*"; Anad Engineering College, Civil Engineering Dept., Agra; (30 pages).

G. Ya. Bulatov, et al.; "*Technology of erecting the foundations—"pile in pipe"*"; Civil Engineering Magazine, 2008, No. 1, pp. 33-37; (10 pages).

* cited by examiner

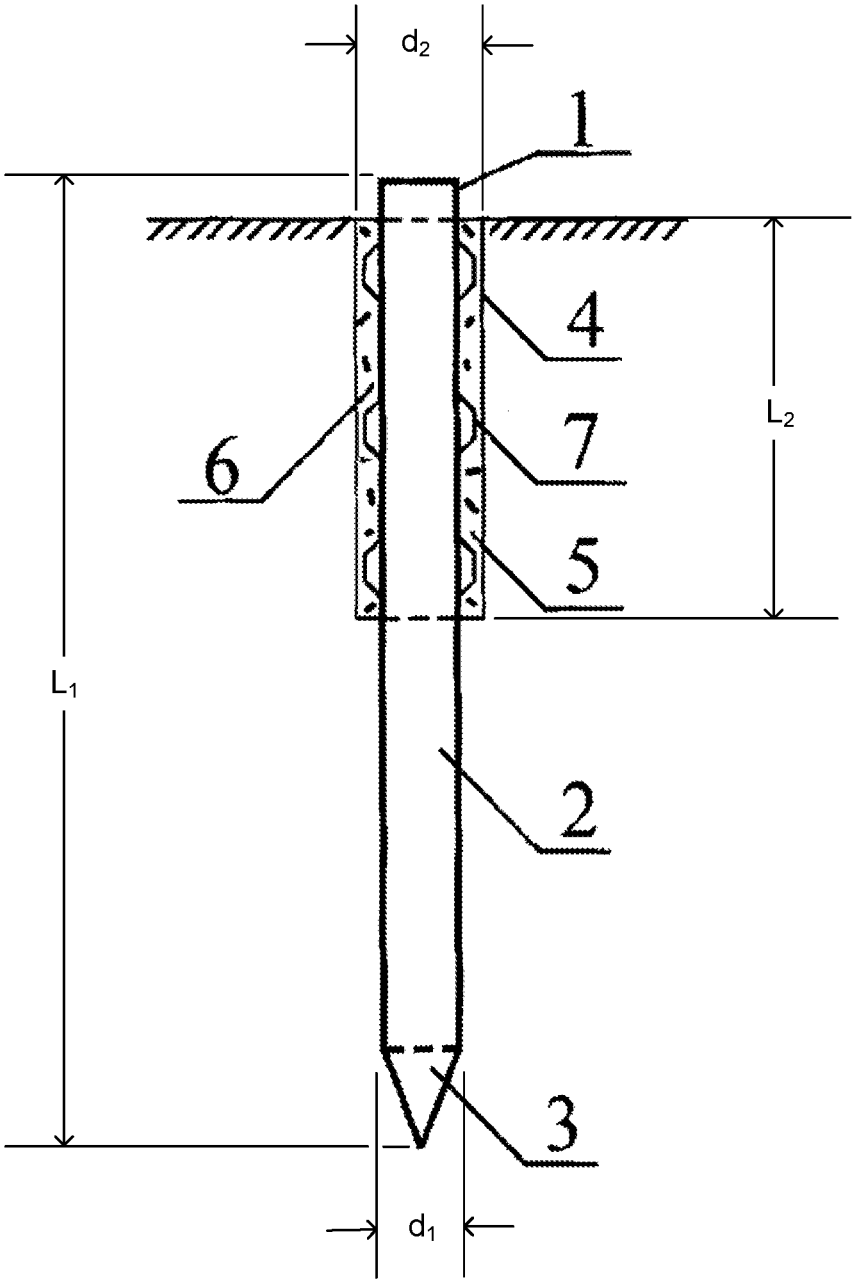
d2
1
4
6
7
5
L2
L1
2
3
d1

METHOD FOR INSTALLING OVERHEAD TRANSMISSION LINE SUPPORTS ON PERMAFROST SOILS

CROSS-REFERENCE TO RELATED APPLICATION

This application claims the benefit and priority of PCT Pat. App. No. PCT/RU2014/000209, titled METHOD FOR INSTALLING OVERHEAD TRANSMISSION LINE SUPPORTS ON PERMAFROST SOILS filed on Mar. 28, 2014, also published as WO/2015/147674.

FIELD

The present disclosure relates to the field of energy and particularly to pile foundations of power transmission towers installed in different types of soil. The invention may be used in construction and repair of pile foundations of power transmission towers, and in other industries, where piles bear horizontal loads and accommodate frost heaving of the soil.

BACKGROUND

Driven piles are used to support power transmission lines and other structures that impose vertical and horizontal loads. Various configurations of driven piles are known in the art.

There is a technology of erection of foundations named "pile in pipe" (G. Ya. Bulatov, A. Yu. Kostyukova, Civil Engineering Magazine. 2008. No. 1, p. 33-37). This technology consists in the following: after immersing a pipe pile, soft ground is being removed from its cavity, soil plug surface is being leveled, soil plug is being compacted, then a layer of drainage material with seal is being put, after that a foundation pile is being installed to transmit the load from the pile work to the soil plug. However, this design does not have high bearing capability under the action of horizontal forces on the pile.

There is a method of constructing a pile foundation (ref. to Canadian patent No. 2540185, published on 31 May 2005, IPC E02D27/12), according to which at least one metal pile is inserted via a through hole, then it is axially fixed in structure, comprises a bar and at least one lower primary head in contact with the ground; the transverse dimensions of the head are greater than those of the hole. The disadvantage of this invention is an insufficient bearing capacity against horizontal loads.

There is a configuration of drilled-in pile comprising a cylindrical shaft made of metal, with a tip connected by butt welding to the end of the cylindrical shaft, and with the cylindrical shaft covered with anticorrosion coating (patent RU No. 123795, IPC E02D5/22).

There is a configuration of piles with increased reliability against the effects of frost heaving of the soil on the pile, comprising a cast-in-situ reinforced concrete shaft, concreted in the hole, with a metal casing in the area of influence of frost soil heaving, whose cross-section is less than the cross section of the hole. The casing has an anti-heaving coating on the outer surface. (patent RU No. 118324, IPC E02D5/60). The disadvantage of the above installations is insufficient bearing capacity against horizontal loads and inability to exclude the impact of frost heaving.

There is a configuration of driven pile comprising a shaft with a longitudinal hole in it, a pointed tip, and a device that increases the bearing capacity of the pile. The bottom of the shaft has a recess with a cylindrical surface, an elastic coating with the tools fastening its upper and lower ends, which covers the cylindrical surface of the recess; a space between the elastic coating and the cylindrical surface of the recess; protective housing extendible in radial axis with its fastening tools on the shaft, and covering the elastic coating. The shaft has a radial hole connecting the longitudinal hole with the above cavity, transformed in a supporting skirt after immersing the pile to a predetermined depth, filling the cavity with hardening mortar through the holes in the shaft and mortar hardening (patent RU No. 85171, IPC E02D5/48). However, fabrication of such a pile structure requires much labor for manufacturing and as a consequence an increased time of the work.

There is a configuration of driven pile comprising a shaft with a longitudinal through hole, a pointed tip, a device increasing the bearing capacity of the pile, positioned between the shaft and the tip in a form of an insert with a longitudinal hole; attached to them, having the elastic coating with the tools to fasten its upper and lower ends, and covering the cylindrical surface of the insert. The cavity between the elastic coating and the cylindrical surface of the insert, a housing extendible in radial axis with its fastening tools on the shaft, covering the elastic coating. The shaft has a radial hole connecting the longitudinal hole with the cavity, transformed in a supporting skirt after immersing the pile to a predetermined depth, filling the cavity with hardening mortar through the holes in the shaft and mortar hardening. The pile shaft may be prismatic or cylindrical, and the tip may be conical, pyramidal or wedge-shaped. The pile has high bearing capacity with reduced power of immersion into the soil (patent RU No. 2386749, IPC E02D5/48). However, this pile design has low bearing capacity when subjected to horizontal forces on the pile, and under the action of wind loads on poles and wires.

Another configuration of piles, in the construction of the pile foundations for resisting major vertical and horizontal loads, includes combined vertical and inclined shafts, with reinforcement cages that increase the stability of the vertical piles by braces and anchors of augercast piles (patent RU No. 2303103, IPC E02D5/46). The disadvantage of this configuration is difficulty and complexity of implementation of this installation, the inability to eliminate the impact of frost heaving forces, and the high cost of the work.

It would be desirable, therefore, to develop new configurations for driven piles that are capable supporting horizontal and vertical loads in soils subject to frost heaving, without exceeding the maximum permissible angles of rotation of the piles and the maximum permissible horizontal displacements, while being more economical in materials and installation costs.

SUMMARY

This summary and the following detailed description should be interpreted as complementary parts of an integrated disclosure, which parts may include redundant subject matter and/or supplemental subject matter. Distinctive features of the proposed pile include attachment of the casing to the fixture of the pile, and the space between the casing and the hole walls being filled with hydrophobic material.

In an aspect of the disclosure, a method for installation of a power transmission tower in a permafrost soil includes driving a casing pipe into the ground and then inserting the pile shaft into the casing pipe. While inserting the pile shaft, rigid elements are installed on the pile shaft by welding, for which the pile shaft is marked to show the point of installation for the rigid elements. When driving the pile shaft, when a lower mark indicating installation of rigid elements reaches the top of the casing pipe, a geometric measurement of gaps is made between the casing pipe and the pile, based on which rigid elements are manufactured to be welded in pairs on the opposite sides in a vertical plane aligned in the direction of insertion. The operation is repeated during the pipe insertion. The pipe insertion step is in the range of 0.5-0.7 m. Rigid elements are installed by welding on the pile shaft during the pile shaft insertion. For this purpose, the pile shaft is marked in the area of mounting of rigid elements. The height of welding zone should be at least 3 meters, the rigid elements length should be 5-15 cm, and the distance between the rigid elements should be 0.35-0.65 m.

To the accomplishment of the foregoing and related ends, one or more examples comprise the features hereinafter fully described and particularly pointed out in the claims.

BRIEF DESCRIPTION OF THE DRAWINGS

The features, nature, and advantages of the present disclosure will become more apparent from the detailed description set forth below when taken in conjunction with the drawings.

FIG. 1 is a schematic diagram illustrating a foundation pile with the casing pipe and rigid elements.

DETAILED DESCRIPTION

Various aspects are now described with reference to the drawings.

Referring to FIG. 1, the following components are illustrated: 1—pile, 2—pile shaft, 3—pile toe bulb, 4—casing pipe, 5—filler, 6—cutoff screen (not visible), 7—rigid elements. Pile 1 comprises shaft 2 and toe bulb 3. The pile shaft 1 may be made of concrete of grade B10-640, of metal roll with 17G1S, 17G1S-U, St2kp, St2ps, St2sp, St3kp, St3ps, St3sp, St3ps3, St3sp3, St3ps4, St3sp40, 9G2S steel grade, K34-K60 strength class, or reinforced concrete. The pile shaft 2 may have a length of $L_1$, for example, in a range of 6-20 m, and a cylindrical shape with a diameter $d_1$, for example, in a range of 15-150 cm. In an alternative, the pile shaft 2 may be rectangular in cross section with sides of dimension, for example, in a range of 10-100 cm. The pile shaft 2 serves to accommodate vertical, horizontal and other loads. The bottom of the pile shaft 2 may be attached with a pile toe bulb 3, which may be tapered, rounded or flat in shape and mounted to the shaft 2 by welding or molded as a single monolithic structure, in the case of configuration of concrete and reinforced concrete piles.

The top of the shaft 2, which is 1 m to ½ m long, may be attached with a cutoff screen 6 and rigid elements 7. The cutoff screen 6 may be made of plastic sheet or metal galvanized sheet. The cutoff screen 6 is installed close to the shaft 2 and fixed to it using a clamp before or during driving the pile 1. The cutoff screen 6 is used to separate the pile 1 from the filling material in order to increase the reliability against the impact of frost heaving of the soil on the pile 1.

Rigid elements 7 of the shaft 2 may be made of metal plates with 09G2S, 10G2, 15GS, 16GS, 17GS steel grade, h long having a length, for example, in a range of 1-50 cm long, S wide a width, for example, in a range of 1-20 cm wide, and a thickness, for example in a range of 0.1-5 cm thick. Rigid elements 7 may comprise a generally flat plate having a shape of square, triangular, circular or other non-arbitrary geometric shape. Rigid elements 7 are installed transverse to the anticipated horizontal forces acting on the pile 1, for example, horizontal forces from transmission lines. As shown in FIG. 1, the rigid elements may be attached in pairs on opposite sides of the shaft 2. The rigid elements 7 may be attached to the shaft 2 by welding vertically spaced apart by not less than the length of the metal plates. Rigid elements 7 serve to transfer horizontal forces of the pile on the casing pipe 4.

The pile shaft 2 is mounted into the casing pipe 4. The casing pipe 4 may be made of pipe metal-roll with 17G1S, 17G1S-U, St2kp, St2ps, St2sp, St3kp, St3ps, St3sp, St3ps3, St3sp3, St3ps4, St3sp40, 9G2S steel grade, K34-K60 strength class, with $L_2$ length, for example, in a range of 1-10 m, with a diameter $d_2$, for example, in a range of 20-200 cm. The casing pipe 4 serves to accommodate horizontal loads from the pile 1 and transfer them to the surrounding soil with a larger work area. The filler 5 of the space between the pile 1 and the casing pipe 4 is cement and sand mortar of M100-M350 grade, or B10-B40 grade concrete, or granular inert non-frost heaving material.

An embodiment is implemented as follows. The casing pipe 4 is driven in and the pile 1 is inserted into it. While inserting the pile 1, rigid elements 7 are installed on the shaft 2 of the pile 1 by welding, for which the pile 1 is marked at the point of installation of rigid elements 7. When driving the pile 1, when the lower mark reaches the top of the casing pipe 4, a geometric measurement of gaps is being made between the casing pipe 4 and the pile 1, based on which rigid elements 7 are manufactured to be welded in pairs on the opposite sides. The operation is similarly repeated during the pile insertion.

The invention claimed is:

1. A method of installation of a power transmission tower on permafrost soil, comprising:

driving a casing pipe into soil to a depth greater than a level of seasonal freezing and thawing of soils for transferring horizontal loads from the power transmission tower to surrounding soil;

inserting a pile into the casing pipe, including driving the pile;

while inserting and driving the pile, installing rigid elements in pairs on a shaft of the pile by welding at predetermined locations for installation of the rigid elements, wherein said installing includes for each pair of the rigid elements:

measuring gaps in between a top of the casing pipe and the pile at a lower end of each predetermined location;

manufacturing each pair of rigid elements comprising a pair of generally flat plates fitting in the gaps, based on the measuring;

welding each pair of rigid elements on opposite sides of and transverse to the shaft at each predetermined location in a vertical plane, positioned to transfer horizontal force from the pile to the casing pipe; and repeating the installing and manufacturing for each of the pairs of rigid elements during the pile insertion and driving.

2. The method of claim 1, wherein a height of a zone of the shaft in which the rigid elements are installed is at least 3 meters.

3. The method of claim 1, wherein a length of the rigid elements is in a range of 5-15 cm.

4. The method of claim 1, wherein the pile is inserted and driven at intervals in a range of 0.5-0.7 m, and a distance between installed pairs of the rigid elements is in a range of 0.35-0.65 m.

5. The method of claim 1, further comprising mounting a cutoff screen on the shaft from an upper part of the shaft to a level of seasonal freezing and thawing of soils.

6. The method of claim 5, wherein the cutoff screen comprises a plastic film or sheet.

7. The method of claim 5, wherein the cutoff screen comprises a galvanized metal sheet.

8. The method of claim 1, further comprising positioning the pairs of the rigid elements on opposite sides of the shaft in a common plane.

9. The method of claim 1, further comprising filling a space between the casing pipe and the shaft with soil.

10. The method of claim 1, further comprising filling a space between the casing pipe and the shaft with one of concrete or mortar.

11. The method of claim 1, wherein each of the rigid elements comprises a steel material.

12. The method of claim 1, wherein each of the rigid elements is in the range of 1-50 cm long, 1-20 cm wide, and 0.1-5 cm thick.

13. The method of claim 1, wherein the shaft comprises a steel material.

* * * * *